US005878461A

United States Patent [19]

Killian

[11] Patent Number: 5,878,461

[45] Date of Patent: Mar. 9, 1999

[54] DEVICE FOR THE COLLECTION, COMPRESSING AND DISCHARGE OF LOOSE MATERIAL

[76] Inventor: John C. Killian, 230 Hilton Ave., Hempstead, N.Y. 11550

[21] Appl. No.: 782,534

[22] Filed: Jan. 10, 1997

[51] Int. Cl.[6] ..... A47L 13/52

[52] U.S. Cl. ..... 15/257.1; 15/257.3; 294/55

[58] Field of Search ..... 15/257.1, 257.3, 15/257.9; 294/1.1, 55

[56] References Cited

U.S. PATENT DOCUMENTS

| | | | |
|---|---|---|---|
| 3,312,263 | 4/1967 | Wahlstrom . | |
| 3,355,187 | 11/1967 | Brindle | 294/1.1 |
| 3,833,249 | 9/1974 | McKinney | 294/1.1 |
| 4,054,957 | 10/1977 | Diamond | 294/55 |
| 4,434,829 | 3/1984 | Barnard . | |
| 4,686,734 | 8/1987 | Kahan | 15/257.1 |
| 4,854,003 | 8/1989 | Roberts | 294/1.1 |
| 5,054,828 | 10/1991 | Hantover . | |
| 5,365,632 | 11/1994 | Kirchnavy | 294/55 |

*Primary Examiner*—Terrence Till
*Attorney, Agent, or Firm*—Ladas & Parry

[57] ABSTRACT

A device for collecting, compressing and discharging loose material, the device being formed from a body of flexible material having a self-sustaining, scoop-shape. The body has a flat bottom, lateral sides, and an open top. The bottom merges with the lateral sides at one of the ends of the body to form a flat edge thereat, and at its other end, the body has an end wall extending upright from the bottom. The lateral sides have upper edges extending from the flat edge upwardly to an upper edge of the end wall thereby defining an open, interior cavity adapted for receiving loose material therein. The lateral sides and the bottom are joined to the end wall by fold lines forming stabilizing corners which provide the self-sustaining shape of the body while the flexible material of the body allows the lateral sides to be overlapped on one another to compress and confine the loose material in the cavity. When the lateral sides are overlapped on one another, an opening is formed from which the compressed, loose material can be discharged into a receptacle.

17 Claims, 3 Drawing Sheets

DEVICE FOR THE COLLECTION, COMPRESSING AND DISCHARGE OF LOOSE MATERIAL

FIELD OF THE INVENTION

The invention relates to devices for the collection, compressing and discharge of loose material, such as leaves, branches and other yard waste.

The invention relates particularly to devices which enable the collection of yard waste at ground level and are able to compress and organize the collected yard waste to facilitate its discharge into a collection receptacle or compost heap.

BACKGROUND AND PRIOR ART

Devices are known for collecting material from a surface to enable transfer of the material to a container. A typical device is a dustpan which has a wide, flat, inflexible front edge over which the material is propelled into a semi-open compartment formed by sides extending from the flat edge to a rear wall. Flat ended shovels are similar in function, and can be pushed into the material to be collected and transferred. Larger devices of this type include front end loaders, bucket loaders and the like.

There are no comparable devices for collecting and transferring the type of material encountered while doing yard work and landscaping. The usual technique for transferring leaves and yard debris into containers is to manually transfer the material using one's hands or by scooping it up with a shovel or rake. To enlarge any of the existing devices to a size adequate for dealing with this type of material would make them too unwieldy for use by individuals doing this type of work.

The major disadvantages of devices currently available for collecting material from a surface for transfer into a container include:

(a) the diameter of the smallest opening through which the material can be securely transferred without a significant chance of spillage is determined by the width of the front edge of the collecting device;

(b) when making a transfer with such a device there is no protection for the sides of the container into which the transfer is being made;

(c) these devices do not have the capability to compress the material that is being transferred;

(d) these devices do not have the capability to orient long, thin components, such as branches, of the material being transferred.

U.S. Pat. No. 4,434,829 discloses a bag type device for collecting, storing and hauling yard debris. Transfer of the debris from the device is a secondary consideration. The device essentially comprises a foldable container which is closed by pivoting the side flaps around a hinge formed by a bottom longitudinal support of a frame such that the upper edges of the side flaps meet along their entire length. The volume of the container cannot be adjusted once it is closed. In the closed state, the collected debris is transported and the material is not compressed. Any long, thin components of the material will not be re-oriented. The size of the opening that is formed when the container is closed is defined by the length of the frame members at the open end and it cannot be adjusted. Furthermore, for emptying the collected contents through the opening, manual pressure must be applied to the frame members to keep the opening open, making it difficult to insert the end of the device into the receiving container for the collected debris.

U.S. Pat. No. 3,312,263 discloses a tote bag for fallen leaves which requires a frame with bracing members for panels of flexible material and shares the disadvantages noted above for the device of U.S. Pat. No. 4,434,829.

SUMMARY OF THE INVENTION

An object of the invention is to provide a device for the collection, compressing and discharge of loose material which avoids the disadvantages of the known art and is of simple, inexpensive construction.

A further object of the invention is to provide such a device which is made of flexible material but which has a self-supporting shape and avoids the need for a support frame.

A further object of the invention is to provide such a device which is capable of compressing the collected material to an adjustable degree.

Another object of the invention is to provide such a device which not only is capable of adjusting the degree of compressing of the collected material but has an outlet opening of adjustable size for discharge of the collected material.

In accordance with the above and further objects of the invention, the device comprises a body of flexible material having a self-sustaining, scoop-shape including a bottom, lateral sides and an open top; the bottom of the body merges with the lateral sides at one of the ends of the body to form a flat edge thereat and at the other end of the body a wall extends upright from the bottom, said lateral sides having upper edges extending from said flat edge upwardly to an upper edge of said wall thereby defining an open, interior cavity for the scoop-shape body adapted for receiving loose material therein. The flexible material of the body enables the lateral sides to be overlapped on one another to compress and confine the loose material in the cavity and when overlapped on one another, the lateral sides define at said one end of the body an opening from which the compressed, loose material can be discharged.

In further accordance with the invention, the opening from which the compressed loose material can be discharged has a variable size which is a function of the amount of overlap of said lateral sides on one another.

In further accordance with the invention, the upright wall of the body defines stabilizing corners with said lateral sides, which confer, with a further corner between said wall and said bottom, said self-sustaining shape of said body.

In further accordance with the invention, the scoop-shape body can be formed from a flat piece of flexible material by providing slits in the material at said other of the ends of the body so that said end wall can be upfolded from said flat piece of material leaving two side flaps extending beyond the up-folded wall, which can be folded onto and secured to said upfolded wall.

In further accordance with the invention, the body is provided with means enabling the lateral sides to be secured when overlapped.

In further accordance with the invention, means can be provided at said bottom of body to preserve said flat edge and prevent unintended roll-up thereof, as the loose material is being introduced into said cavity.

The device of the invention provides the following advantages:

(a) it can be partially inserted into a receiving container so that as the transfer of the loose material is being made, the sides of the container are protected from being damaged by the loose material being transferred, (b) it can compress large amounts of material into a smaller volume for transfer into the receiving container, (c) it can re-orient the longitudinal axes of long, thin components of the loose material being transferred, i.e. branches or the like, to facilitate their placement in the receiving container, (d) it is inexpensive and easy to use, and (e) it can be assembled from a flat piece of material by the user.

DETAILED DESCRIPTION OF PREFERRED EMBODIMENTS

Figure 1:
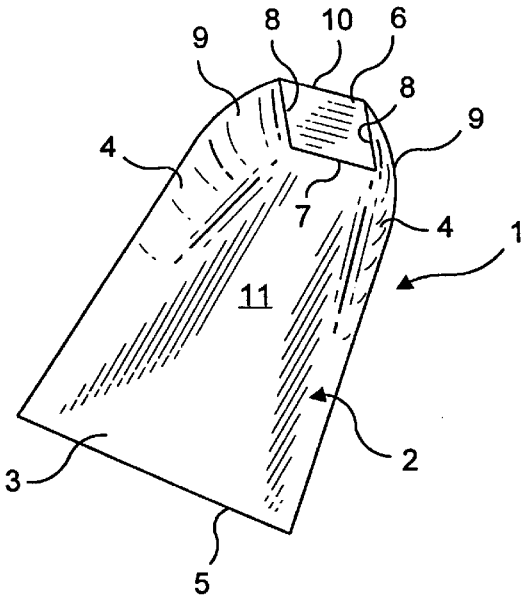
FIG. 1 is a top, perspective view showing one embodiment of the device according to the invention in an open position adapted for receiving loose material.
Figure 1A:
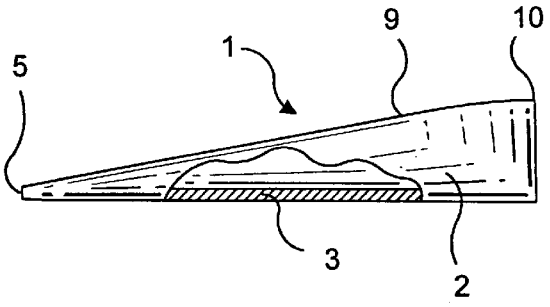
FIG. 1A is a side, elevation view, partly broken away and in section, of the device of FIG. 1.

Referring to FIG. 1 of the drawing, therein is illustrated a device 1 according to the invention for collecting, compressing and discharging loose material. The device 1 comprises a body 2 of flexible material which can be paper, plastic material or fabric. The material can be solid or porous. The body 2 is provided with a self-sustaining, scoop shape in a manner to be explained later. The scoop-shape body 2 has a bottom 3 which is substantially flat and which joins with lateral sides 4. The lateral sides 4 merge with the bottom 3 at a flat edge 5 at one of the ends of the body. At the opposite end of the body, a rectangular end wall 6 extends upright from the bottom 3 at a transverse fold 7 and the wall 6 is joined to the side walls 4 at vertical folds 8. The lateral sides 4 have upper edges 9 which extend from flat edge 5 upwardly to an upper edge 10 of wall 6. Thereby, the body 2 is formed with an open top defining an interior cavity 11. The interior cavity 11 is bounded by lateral walls 4 and end wall 6 and is adapted for receiving loose material therein. The folds 7 and 8 form stabilizing corners which provide the self-sustaining, scoop-shape of the body even thought the material of the body itself is flexible and normally will not permit itself to assume a particular shape. This will be explained more fully later.

Figure 5:
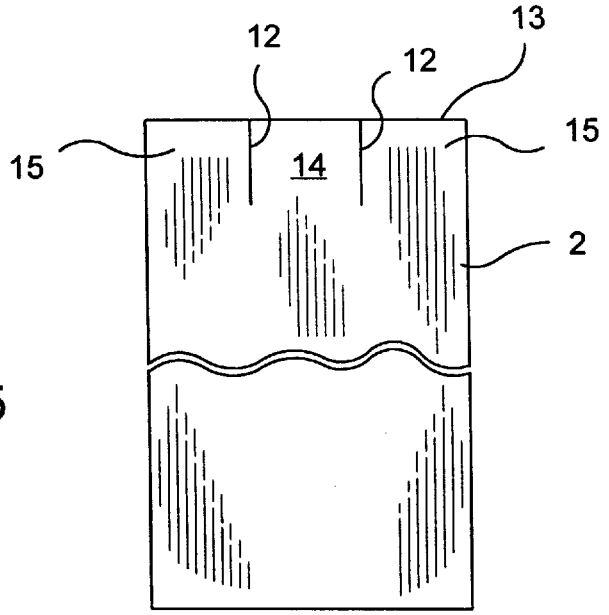
FIG. 5 is a plan view of the device in FIG. I in an initial state prior to its assembly.
Figure 6:
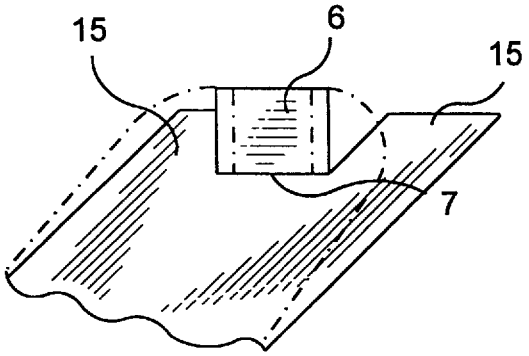
FIG. 6 shows the device of FIG. 5 in a partially assembled state.
Figure 7:
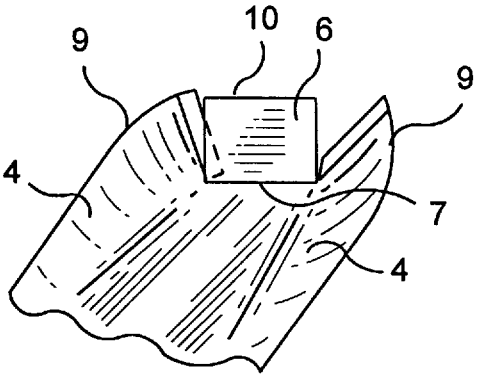
FIG. 7 shows the device in a further assembled state.
Figure 8:
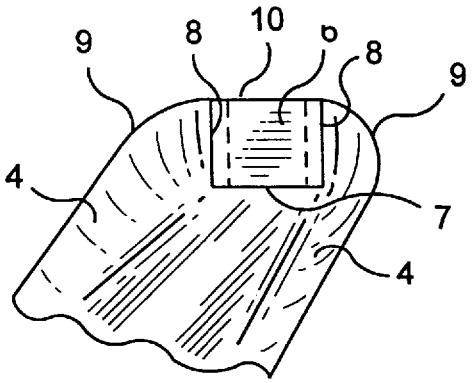
FIG. 8 shows an end wall portion of the device in its fully assembled state.

FIGS. 5–8 illustrate how the body I can be produced. FIG. 5 shows the material of the body laid flat on a surface. The material is provided with two slits 12 extending longitudinally from edge 13 at an end of the body partially along the length of the body to form a middle flap 14 which can be up-folded from the material as shown in FIG. 6 to constitute the end wall 6 of the body. Two flaps 15 remain when the end wall is upfolded. The flaps 15 are raised and folded in back of the end wall 6 in the manner illustrated in FIGS. 7 and 8 and are secured to the end wall and to one another by suitable means, such as adhesive, staples or the like. When the flaps 15 are thus secured to the end wall 6, the self-sustaining, scoop-shape of the body is obtained. As an alternative, the body of material can be developed in a particular configuration so that it can be formed into the shape of body 1 from a single piece of unslit material.

It is a particular feature of the invention that the body 1 can be formed with the self-sustaining, scoop-shape without need for a support frame or the like, and without using any reinforcement at the end wall or the lateral sides.

Figure 2:
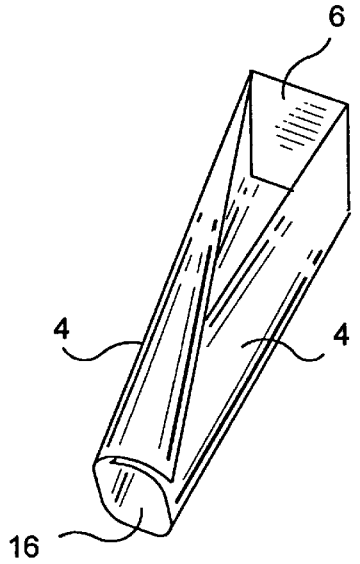
FIG. 2 shows the device of FIG. 1 in a condition in which lateral sides of the device are overlapped.

In use, the body 1 is placed in its open state as shown in FIG. 1 on the ground or other surface where debris is to be collected. In the case of yard debris constituted by loose material, such as leaves, branches and the like, the loose material is raked or otherwise propelled over edge 5 into the cavity 11 within the scoop-shape body 2. The loose material is confined within the cavity by the lateral sides 4 and the end wall 6. After a determined amount of material has been introduced into the cavity 11, the lateral sides 4 are brought together and overlapped on one another as shown in FIG. 2. The loose material in cavity 11 is compressed and any long thin components of the loose material which are longer then the width of the newly configured, partially enclosed container will be reoriented so that their longitudinal axes will be aligned with that of the container. The lateral sides 4 are overlapped at edge 5 to form a substantially cylindrical opening 16 from which the compressed, loose material can be discharged. The discharge of the loose material is achieved by inserting the cylindrical opening 16 into a rigid or flexible trash container so that the loose material can be transferred through the cylindrical opening 16 into the receptacle. The overlapped sides 4 protect the sides of the container from damage. As the end of the body is withdrawn from the container, the loose material remains inside the container in a compressed state in which any long, thin components of the loose material are aligned to fit inside the container.

Figure 3:
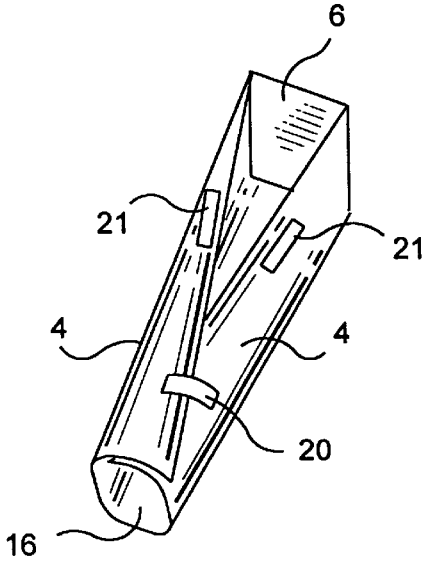
FIG. 3 shows the device according to FIG. 2 with a means for securing the overlapped sides and with handle means for transporting the device.

Referring to FIG. 3, therein is seen an attachment or securing means 20 for securing the lateral sides 4 when they are overlapped on one another. The securing means 20 can be in the form of adhesive strips on one of the lateral sides 4 to enable the lateral sides to be secured in varying overlapped amounts. The securing means can also be in the form of VELCRO strips.

Handles 21 can be provided on the lateral sides 4 to enable the body 2 to be carried and to be held while the loose material is discharged from the opening 16. It is to be noted that the lateral sides 4 overlap one another by an amount which is maximum at the opening 16 and diminishes to zero towards end wall 6 at a location spaced from end wall 6. The handles 21 are provided on the lateral sides 4 where the sides do not overlap. This enables the closed body 2 to be transported and inserted to a maximum depth within the receiving container. The handles 21 can be formed by providing slots in the side walls adjacent to the upper edges 9. Handles can also be provided on the end wall to help in lifting the body.

Figure 4:
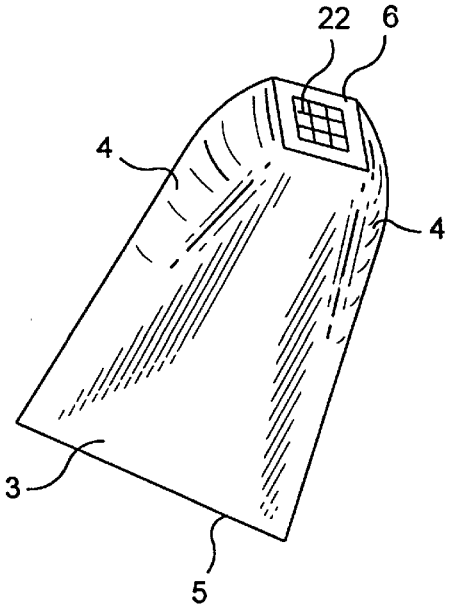
FIG. 4 shows a modified embodiment of the device of FIG. 1.

In a modification shown in FIG. 4, the end wall 6 is provided with a vent opening 22, formed, for example, by a screen to provide a lattice-like outlet for air produced, for example, by a blower used to blow the loose material into the cavity of the body. The opening 22 also facilitates the overlapping of the lateral sides 4 onto one another and the compressing of the loose material by allowing escape of air through the opening 22. The opening 22 can also be provided with a removable cover or hinged door. A spout could also be provided at the opening 22 to allow material to be poured out at the end wall.

The composition of the material of the body 2 and its thickness is not critical, provided that the material is sufficiently sturdy to be self-sustaining in shape when erected as shown in FIG. 1 and to allow the lateral sides to be able to be overlapped to enclose and compress the loose material and form the outlet opening 16. By way of example, the material can be a paper product varying in thickness between 0.003" and 0.010" or a plastic film of a thickness between 0.010" and 0.100" or a fabric, such as "landscape fabric" of a thickness between 0.010" and 0.100". The material can be solid or porous.

When the material of the body 2 is relatively thin, there may be a tendency for the edge 5 to "roll-up" and not remain flat against the ground when the loose material is being introduced into the cavity 11. In order to preserve the flat edge 5 and prevent unintended roll-up, the invention provides various means as shown in FIGS. 9 and 10.

Figure 9:
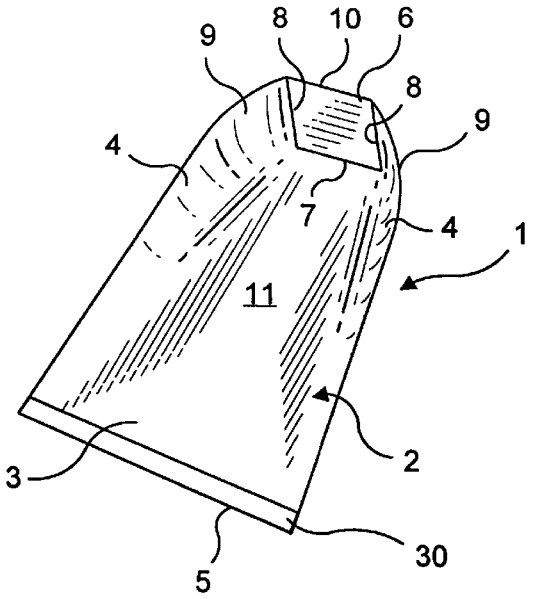
FIG. 9 is similar to FIG. 1 but shows a modified embodiment of the device.
Figure 10:
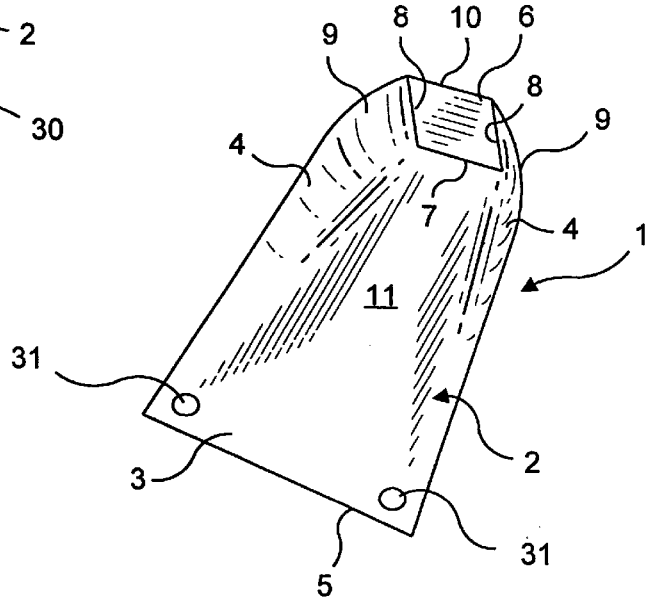
FIG. 10 is similar to FIG. 1 but shows another modified embodiment of the device.
Figure 11:
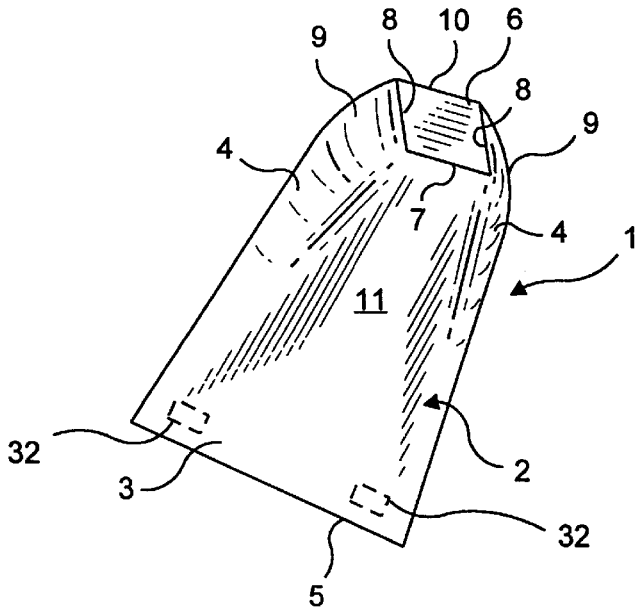
FIG. 11 is similar to FIG. 1 but shows another modified embodiment of the device.

Referring to FIG. 9, which utilizes the same reference numerals as in FIG. 1 to designate the same elements, the body 1 is provided with a reinforcement 30 extending all along edge 5 which acts to hold the edge 5 flat against the ground. The reinforcement 30 can be constituted by an increased thickness of material or by separate attachment of a strip of spring steel or other suitable more rigid material. In another embodiment shown in FIG. 10, the bottom 3 is provided with holes 31 adjacent to edge 5 in proximity to side walls 4, i.e. at the corners of the body at the open end. Stakes or other removable retainer means can be passed through the holes 31 into the ground to prevent roll-up of the edge 5. Instead of holes 31, weights 32 can be secured to the bottom 3 at the corners as shown in FIG. 11 to hold the flat edge against the ground.

Although the invention has been described in conjunction with specific embodiments thereof it would, be apparent to those skill in art that numerous modifications and variations can be made within the scoop and spirit of the invention as defined in the attached claims.

What is claimed:

1. A device for collecting, compressing and discharging loose material, said device comprising a body of flexible material having a self-sustaining, scoop-shape including a bottom, lateral sides, and an open top, said body having opposite ends, said bottom merging with said lateral sides at one of said ends of the body to form a flat edge thereat, the other of said ends of said body including an end wall extending upright from said bottom, said lateral sides having upper edges extending from said flat edge upwardly to an upper edge of said end wall thereby defining an open interior cavity for said scoop-shape body adapted for receiving loose material therein, said end wall having a quadrangular configuration and defining stabilizing corners with said lateral sides and said bottom which provide said self-sustaining shape of said body, said flexible material of said body enabling said lateral sides to be overlapped on one another to compress and confine the loose material in said cavity, said lateral sides when overlapped on one another defining at said one end of the body an opening from which the compressed, loose material can be discharged.

2. A device as claimed in claim 1, wherein said opening from which the compressed, loose material can be discharged has a variable size which is a function of the amount of overlap of said lateral sides on one another.

3. A device as claimed in claim 1, wherein said flexible material is selected from the group consisting of paper, plastic and fabric.

4. A device as claimed in claim 3, wherein said flexible material is selected from the group consisting of porous and solid materials.

5. A device as claimed in claim 1, further comprising means at said bottom of the body to preserve said flat edge, as the loose material is being introduced into said cavity and prevent unintended roll-up of said flat edge.

6. A device as claimed in claim 5, wherein said means to preserve said flat edge comprises a reinforcement in said body at said flat edge.

7. A device as claimed in claim 5, wherein said means to preserve said flat edge comprises hole means in said bottom adjacent to said flat edge through which a retainer means can pass and be secured in the ground to hold said flat edge against the ground.

8. A device as claimed in claim 5, wherein said means to preserve said flat edge comprises weights secured to said bottom at said flat edge.

9. A device for collecting, compressing and discharging loose material, said device comprising a body of flexible material having a self-sustaining, scoop-shape including a bottom, lateral sides, and an open top, said body having opposite ends, said bottom merging with said lateral sides at one of said ends of the body to form a flat edge thereat, the other of said ends of said body including an end wall extending upright from said bottom, said lateral sides having upper edges extending from said flat edge upwardly to an upper edge of said end wall thereby defining an open interior cavity for said scoop-shape body adapted for receiving loose material therein, said flexible material of said body enabling said lateral sides to be overlapped on one another to compress and confine the loose material in said cavity, said lateral sides when overlapped on one another defining at said one end of the body an opening from which the compressed, loose material can be discharged, and wherein said scoop-shape body is formed from a flat piece of said flexible material provided with longitudinal slits at said other of said ends of the body extending partially along the length thereof so that said end wall can be upfolded from said flat piece of material leaving two side flaps, extending beyond the thus upfolded end wall, which side flaps are folded onto and secured to said upfolded, end wall.

10. A device for collecting, compressing and discharging loose material, said device comprising a body of flexible material having a self-sustaining, scoop-shape including a bottom, lateral sides, and an open top, said body having opposite ends, said bottom merging with said lateral sides at one of said ends of the body to form a flat edge thereat, the other of said ends of said body including an end wall extending upright from said bottom, said lateral sides having upper edges extending from said flat edge upwardly to an upper edge of said end wall thereby defining an open interior cavity for said scoop-shape body adapted for receiving loose material therein, said flexible material of said body enabling said lateral sides to be overlapped on one another to compress and confine the loose material in said cavity, said lateral sides when overlapped on one another defining at said one end of the body an opening from which the compressed, loose material can be discharged, and wherein said end wall is provided with a ventilation opening therein.

11. A device as claimed in claim 10, wherein said ventilation opening is of lattice-like configuration.

12. A device for collecting, compressing and discharging loose material, said device comprising a body of flexible material having a self-sustaining, scoop-shape including a bottom, lateral sides, and an open top, said body having opposite ends, said bottom merging with said lateral sides at one of said ends of the body to form a flat edge thereat, the other of said ends of said body including an end wall extending upright from said bottom, said lateral sides having upper edges extending from said flat edge upwardly to an upper edge of said end wall thereby defining an open interior cavity for said scoop-shape body adapted for receiving loose material therein, said flexible material of said body enabling said lateral sides to be overlapped on one another to compress and confine the loose material in said cavity, said lateral sides when overlapped on one another defining at said one end of the body an opening from which the compressed, loose material can be discharged, and wherein said lateral sides can be overlapped on one another in varying amount to adjust the size of said opening from which the compressed, loose material can be discharged, and comprising means for securing said lateral sides when overlapped on one another.

13. A device as claimed in claim 12, wherein said means for securing said lateral sides is secured to said body and enables said lateral sides to be secured in varying overlapped amounts.

14. A device as claimed in claim 12, comprising handle means secured to said lateral sides to enable the body to be carried and held when the loose material is discharged from said opening.

15. A device as claimed in claim 14, wherein said lateral sides overlap one another in a varying amount which is maximum at said opening and diminishes, towards said end wall, to a location at which the lateral sides no longer overlap.

16. A device as claimed in claim 15, wherein said handle means comprises handles on said lateral sides in a region thereof where said lateral sides do not overlap.

17. A device as claimed in claim 16, wherein said handles are located on said lateral sides between said end wall and the means for securing the lateral sides.

* * * * *